US010376109B2

(12) United States Patent
Fellhoelter

(10) Patent No.: US 10,376,109 B2
(45) Date of Patent: Aug. 13, 2019

(54) PAPER PRODUCT DISPENSER

(71) Applicant: Scott Fellhoelter, Canyon Lake, CA (US)

(72) Inventor: Scott Fellhoelter, Canyon Lake, CA (US)

( * ) Notice: Subject to any disclaimer, the term of this patent is extended or adjusted under 35 U.S.C. 154(b) by 470 days.

(21) Appl. No.: 15/161,737

(22) Filed: May 23, 2016

(65) Prior Publication Data

US 2016/0262580 A1 Sep. 15, 2016

(51) Int. Cl.

| | |
|---|---|
| ***A47K 10/36*** | (2006.01) |
| ***B65H 26/06*** | (2006.01) |
| ***A47K 10/32*** | (2006.01) |

(52) U.S. Cl.

CPC ..... *A47K 10/3687* (2013.01); *A47K 10/36* (2013.01); *B65H 26/06* (2013.01); *A47K 2010/326* (2013.01); *A47K 2010/3226* (2013.01); *A47K 2010/3668* (2013.01); *A47K 2010/3693* (2013.01)

(58) Field of Classification Search

CPC ..... A47K 2010/3668; A47K 10/24; A47K 10/32; A47K 10/34; A47K 10/36; A47K 10/3687; A47K 2010/3693; A47K 2010/326; A47K 2010/3253; A47K 2010/3226; B65H 16/10; B65H 16/106; B65H 26/00; B65H 26/06

USPC ..... 242/562, 563, 563.2, 564, 564.3, 564.4, 242/564.5

See application file for complete search history.

(56) References Cited

U.S. PATENT DOCUMENTS

| | | | | |
|---|---|---|---|---|
| 4,012,608 | A * | 3/1977 | Lockard | H01H 15/005 200/16 D |
| 6,279,777 | B1 | 8/2001 | Goodin et al. | |
| 2002/0109034 | A1 | 8/2002 | Moody et al. | |
| 2003/0168549 | A1 | 9/2003 | Formon et al. | |
| 2003/0182221 | A1* | 9/2003 | Forrest | G06Q 20/403 705/36 R |
| 2005/0145745 | A1 | 7/2005 | Lewis et al. | |
| 2006/0166725 | A1* | 7/2006 | Saffari | G07F 17/32 463/2 |
| 2007/0176041 | A1 | 8/2007 | Friesen et al. | |
| 2010/0253516 | A1* | 10/2010 | Lemerand | E05F 15/70 340/545.1 |

OTHER PUBLICATIONS www.wisegeek.com/what-is-a-thermopile.htm (i.e. WiseGeek) from Wayback Machine Webpage Oct. 5, 2009 (Year: 2009).*

* cited by examiner

*Primary Examiner* — Michael R Mansen
*Assistant Examiner* — Juan J Campos, Jr.
(74) *Attorney, Agent, or Firm* — Cislo & Thomas, LLP

(57) ABSTRACT

A paper product dispenser that includes a toilet paper spindle adapted to hold and dispense a toilet paper roll, at least one motor connected to the toilet paper spindle, a controller connected to the motor, and a thermopile sensor in communication with the controller, the thermopile sensor comprising a plurality of thermocouples that form a junction A and a junction B, wherein when the thermocouples sense thermal radiation, thermal gradient between junction A and junction B is created, the thermal gradient generating an electrical signal that the thermopile sensor sends to the controller.

33 Claims, 14 Drawing Sheets

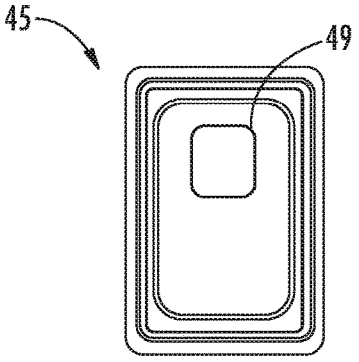
FIG. 19A
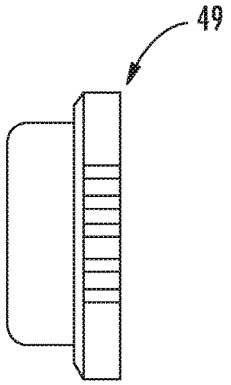
FIG. 19B
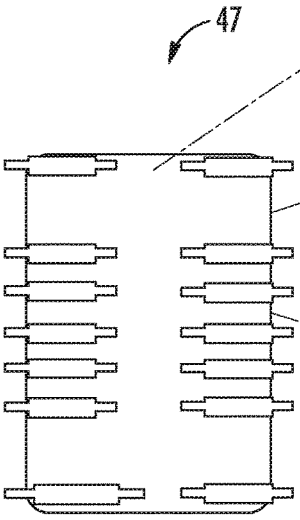
FIG. 19C
| | | | | | | | |
|---|---|---|---|---|---|---|---|
| 64 | 63 | 62 | 61 | 60 | 59 | 58 | 57 |
| 56 | 55 | 54 | 53 | 52 | 51 | 50 | 49 |
| 48 | 47 | 46 | 45 | 44 | 43 | 42 | 41 |
| 40 | 39 | 38 | 37 | 36 | 35 | 34 | 33 |
| 32 | 31 | 30 | 29 | 28 | 27 | 26 | 25 |
| 24 | 23 | 22 | 21 | 20 | 19 | 18 | 17 |
| 16 | 15 | 14 | 13 | 12 | 11 | 10 | 9 |
| 8 | 7 | 6 | 5 | 4 | 3 | 2 | 1 |
FIG. 19D
31

PAPER PRODUCT DISPENSER

CROSS-REFERENCE TO RELATED APPLICATIONS

This application is a continuation-in-part application of U.S. application Ser. No. 14/707,960 filed on May 8, 2015. U.S. application Ser. No. 14/707,960 is a continuation-in-part application of U.S. application Ser. No. 11/784,564, filed on Apr. 9, 2007, which claims the benefit of Provisional Application Ser. No. 60/765,079 filed Feb. 6, 2006, the disclosures of which are hereby incorporated in their entirety by reference herein.

TECHNICAL FIELD

The present disclosure relates to paper product dispensers, particularly automatic touchless paper product dispensers.

BACKGROUND

Existing toilet paper dispensers manually dispense the toilet paper. Users of these dispensers have to hold the toilet paper roll to tear the toilet paper. Harmful microorganisms, such as germs, bacteria, or virus, from the users' hands are transferred to the roll of toilet paper. Moisture from the user's hands is also absorbed into the roll. The next person who uses the roll of toilet paper may receive the harmful microorganisms. Reducing the chances of the harmful microorganisms being transferred between users of the same toilet paper roll is desired.

U.S. Pat. No. 5,312,021 issued to Nelson on May 17, 1994, U.S. Pat. No. 4,071,200 issued to Stone on Jan. 31, 1978, U.S. Pat. No. 3,450,363 issued to J. L. Williams on Jun. 17, 1969, U.S. Pat. No. 3,317,150 issued to E. J. Summersby on May 2, 1967, U.S. Pat. No. 3,297,269 issued to E. F. McGrew on Jan. 10, 1967 and U.S. Pat. No. 3,167,267 issued to M. Rozlog et al on Jan. 26, 1965 all disclose a single roll toilet paper dispensers where a user presses a button to dispense toilet paper. One disadvantage of the dispensers disclosed in the above disclosures is that users have to press a button, which can carry and transmit harmful microorganisms to those who subsequently touch it.

Another problem with existing paper product dispensers is that they are not automatically monitored for maintenance. When they run out of paper or if they breakdown, the patrons have to wait for maintenance personnel to refill the paper or fix the dispensers, which may involve a lengthy downtime. The restroom stall becomes unusable during the downtime period. Another problem is that they do not have a mechanism that limits the amount of toilet paper being dispensed. Some patrons can vandalize them or engage in horseplay by getting unlimited amount of toilet paper and scattering contaminated toilet paper all over the restroom. The lack of mechanism to limit toilet paper being dispensed can also lead to excess use of toilet paper, clogged toilets, or the toilet paper running out quickly thereby requiring additional resources. Another problem is that they only store one roll of toilet paper. When the roll of toilet paper runs out, the person using the toilet has no reserve toilet paper to use.

The above problems and other problems are addressed by this disclosure as summarized below.

SUMMARY

The present disclosure relates to a toilet paper dispenser that includes a toilet paper spindle adapted to hold and dispense a toilet paper roll, at least one motor connected to the toilet paper spindle, a controller connected to the motor, and a thermopile sensor in communication with the controller and comprising a plurality of thermocouples that form a junction A and a junction B, wherein when the thermocouples sense thermal radiation, thermal gradient between junction A and junction B is created, the thermal gradient generating an electrical signal that the thermopile sensor sends to the controller.

The toilet paper dispenser may include a communication device adapted to connect the toilet paper dispenser to a network. In other embodiments, a paper empty sensor is provided in communication with the controller and is adapted to detect presence and absence of paper. When the paper empty sensor detects absence of paper, the paper empty sensor sends a signal to the controller. The controller sends a service signal through the network that can be received by a device that is connected to the network. The toilet paper dispenser further includes a front cover and a main chassis that encase the dispenser. A front cover sensor is provided and is adapted to detect an open position of the front cover. The front cover sensor is also in communication with the controller. When the front cover is in the open position, the front cover sensor sends a signal to the controller. The controller sends a service signal through the network that can be received by any device that is connected to the network. In certain embodiments, the toilet paper dispenser includes an LED connected to the controller and adapted to provide an indication of a status of the dispenser. The LED may be activated by the controller when the paper empty sensor detects absence of paper, when the front cover is in the open position, or when the battery meter senses a predetermined threshold of battery power.

The present disclosure also relates to a paper product dispenser that includes a motor adapted to dispense a paper product; a controller, and a thermopile sensor in communication with the controller, the thermopile sensor including a plurality of thermocouples adapted to detect a change in temperature, wherein when the thermopile sensor detects a change in the temperature, the thermopile sensor sends a signal to the controller, the controller processes the signal and compiles the signal to generate occupancy data.

The present disclosure further relates to a paper product dispenser that includes a motor adapted to dispense a paper product, a controller having a firmware, a thermopile sensor in communication with the controller, the thermopile sensor including a plurality of thermocouples adapted to detect a change in temperature, wherein when the thermopile sensor detects a change in the temperature, the thermopile sensor sends a signal to the controller, and a dual in-line package switch connected to the controller, the dual in-line package switch including a plurality of levers arranged in series, each lever being moveable in a plurality of positions, the positions of the levers being readable by the firmware.

BRIEF DESCRIPTION OF THE DRAWINGS

FIG. 19*a* is a front view of another thermopile sensor.

FIG. 19*b* is a side view of the thermopile sensor of FIG. 19*a*.

FIG. 19*c* is a rear view of the thermopile sensor of FIG. 19*a*.

FIG. 19*d* is a front view of the pixel array of thermocouples of thermopile sensor of FIG. 19*a*.

DETAILED DESCRIPTION

Figure 1:
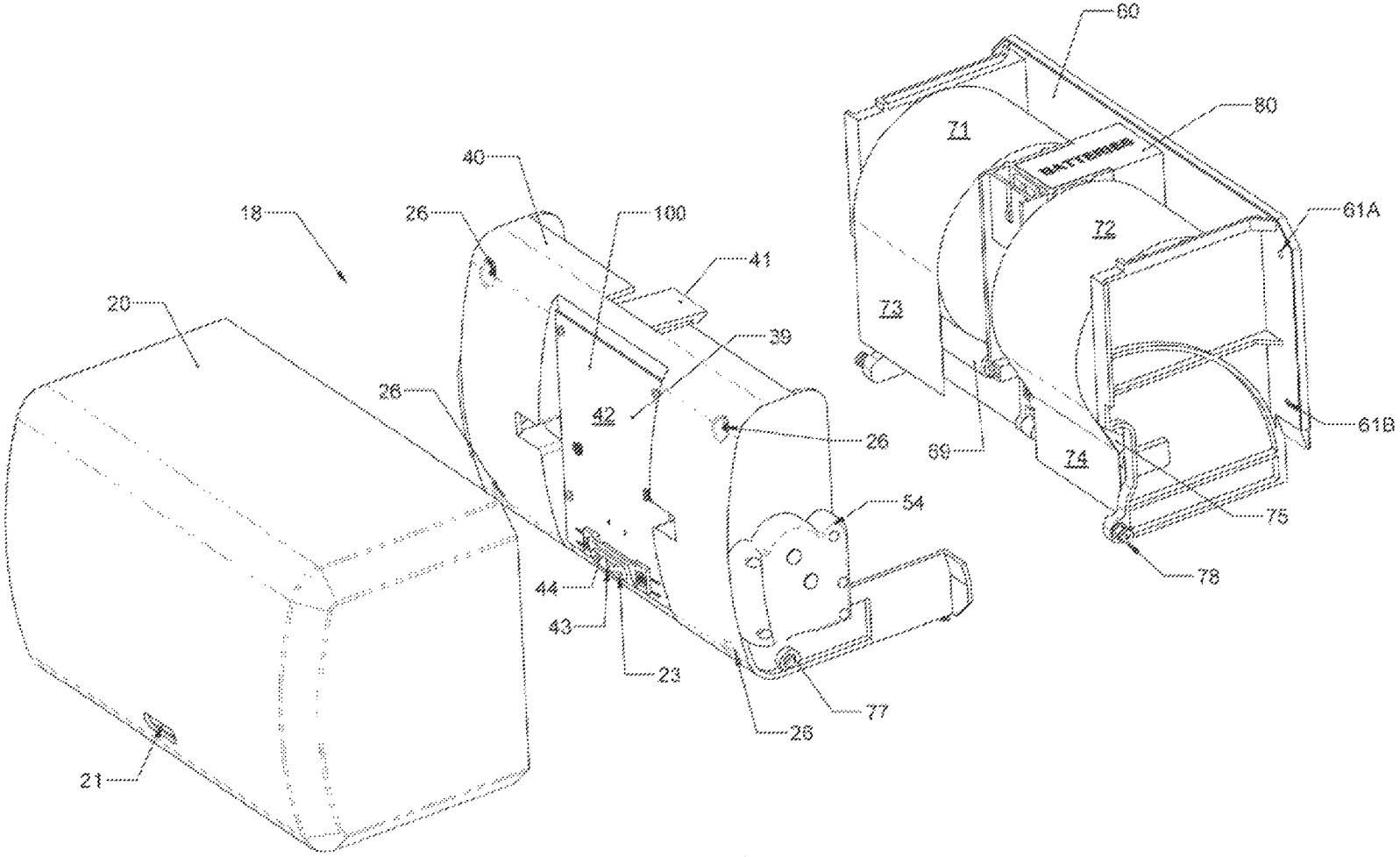
FIG. 1 is a perspective exploded view of an embodiment of the toilet paper dispenser of the present disclosure.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The present disclosure relates to paper product dispensers. In one embodiment, the paper product dispenser is automatic, touchless, and can store and dispense multiple rolls of toilet paper. FIG. 1A is a perspective exploded view of an embodiment of paper product dispenser 18. The paper product dispenser 18 has a front cover 20, a power module 40, and a main chassis 60 that are connected to each other. The front cover 20 is a decorative cover that may be made of non-porous plastic or metal and that can be made to match a particular décor as desired. The front cover 20 is preferably fabricated from a non-porous plastic material or metal material that is resistive to contamination. The front cover 20 is coated with an anti-microbial surface, such as copper, which may be combined with nickel and a final finish, such as stainless steel, to reduce contamination. The front cover 20 further includes seals to protect the internal mechanisms and the paper products, such as toilet paper rolls 71, 72, that are stored within the cover. The seals provide protection from contamination, toilet splash, or water that may get to the toilet paper rolls, such as when a restroom is washed down or when a restroom in a hospital or health care facility is being decontaminated. The front cover defines an opening 21 for a hand motion sensor 43 and a notification light in the form of a multi-colored light emitting diode ("LED") 44. In certain embodiments, the opening 21 is covered by a cover, such as the braille cover 22 shown in FIG. 2A, to protect the internal mechanism and the paper product from contamination. In other embodiments, the hand motion sensor 43 and the LED 44 are encased in a housing 23 that serves as a cover for the opening 21.

The middle component is the power module 40. The power module 40 is attached to the front cover 20 by applying fasteners at mounting points 26. The notification LED 44 and the hand motion sensor 43 are attached to the power module 40 at a location where it will align with the opening 21 of the front cover 20. The notification LED 44 provides a light display that provides various signals, including an indication of the status of the dispenser, such as the status of the batteries, whether the front cover 20 is closed properly, and whether there is toilet paper that is dispensable through the dispenser. The hand motion sensor 43 detects motion of a hand being waved in front of it to request for toilet paper to be dispensed. When the hand motion sensor 43 detects hand motion, it activates a motor that causes the toilet paper to be dispensed. The hand motion sensor 43 is preferably an infrared sensor. One of the drive gear box 54 is visible on the side of the power module 40. A locking latch 41 attaches the top portion of the power module 40 to the main chassis 60. The bottom portion of the power module 40 includes is a pair pivot pin retainers 77 adapted to engage with their respective pivot pins 78 that are on the bottom of the main chassis 60. The pivot pin retainer 77 allows the power module 40 and the front cover 20 to pivot relative to the main chassis 60 to open and close the front cover 20. The power module 40 further includes a circuit board 42 where a controller 100 and an occupant sensor 39 are installed. The occupant sensor 39 is aimed at the opening 21 and detects the presence of a human being near the dispenser by detecting changes in the local temperature caused by the body of the human being. When the occupant sensor 39 detects a local temperature change that exceeds a predefined threshold, the occupant sensor 39 sends a signal to a controller 100. The controller 100 may count the number of signals it has received so that the number of occupants detected in a predefined amount of time can be determined. The occupant sensor 39 is preferably a thermopile sensor. The sensitivity of the thermopile sensor is adjustable. For instance, the size of the bathroom stall can be taken into account so that only the occupant in the stall would generate the appropriate signal to the controller.

The rear component is the main chassis 60. In FIG. 1, two toilet paper rolls 71 and 72 are shown installed in the main chassis 60. Each roll of toilet paper 71 and 72 has a free end 73, 74 respectively that is driven over their respective idle rollers 69, 75 and out of the dispenser. A battery compartment 80 houses batteries, which serve as the power source that operates the dispenser. Various mounting holes 61*a-b* are provided to allow the dispenser to be mounted onto a wall or onto a side of a bathroom stall. The overall depth of the dispenser is just slightly larger than the roll of toilet paper 71, 72.

Figure 2B:
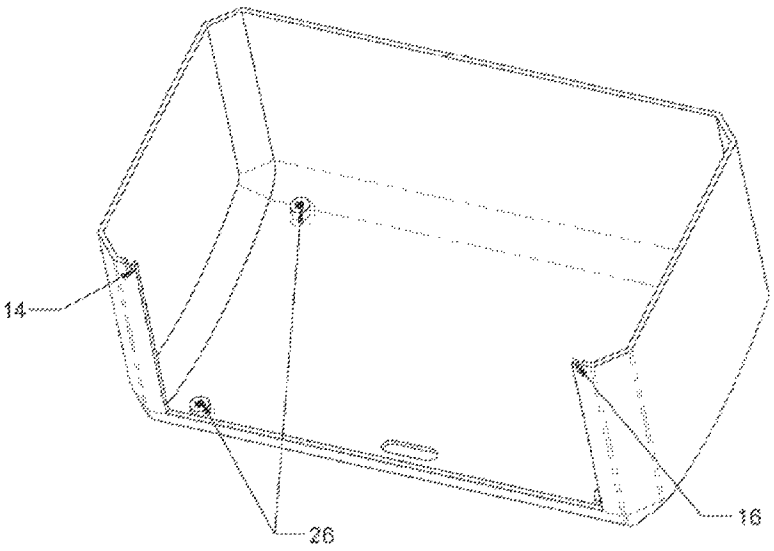
FIG. 2B is a perspective view of an interior of the front cover of FIG. 2A.
Figure 2A:
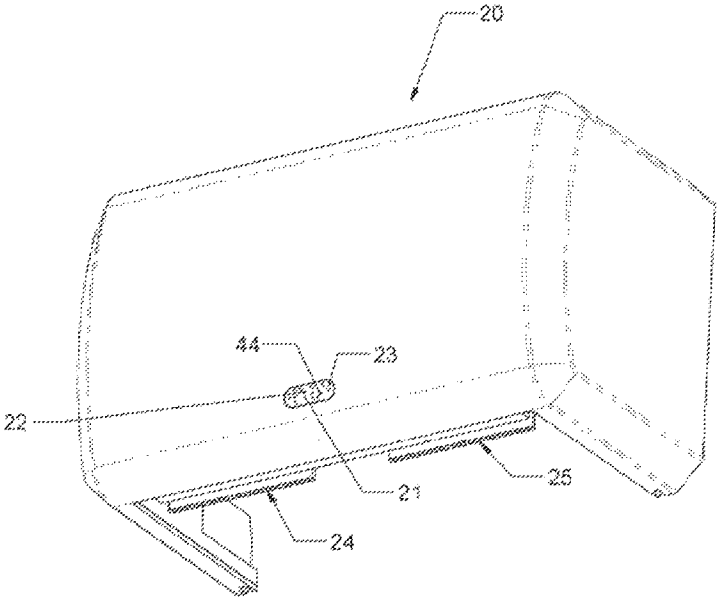
FIG. 2A is a perspective view of an exterior of a front cover.

FIG. 2A is a perspective view of the exterior of the front cover 20. Opening 21 may be covered by a braille cover 22, which has several characters represented by a pattern of raised dots for the visually handicapped to feel when using the dispenser. The braille cover 22 also serves as an LED notification window 23 where the notification LED 44 displays various signals to indicate the status of the dispenser, such as whether there are any operating errors, toilet paper jams, the status of the batteries, whether the front cover 20 is closed properly, and whether any of the toilet paper rolls are empty. In alternative embodiments, braille cover 22 is replaced by a transparent cover material, such as plastic or glass, to cover the opening. A sign with braille characters may be provided and attached to the front cover 20 at a location that is different from the opening 21. The bottom of the front cover 20 shows the paper cutting edges 24 and 25 for each roll of toilet paper.

Figure 3:
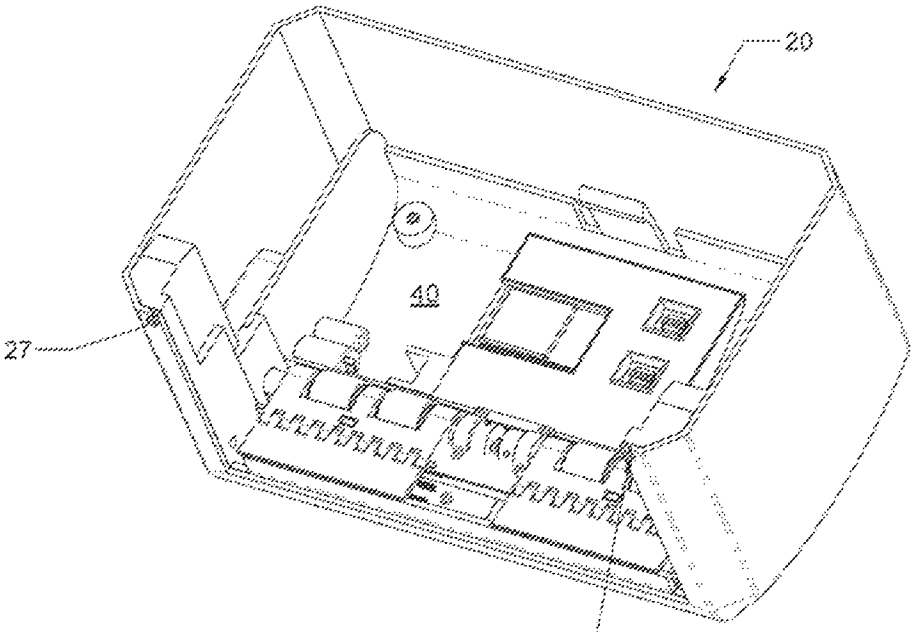
FIG. 3 is an interior perspective view of the front cover and the power module attached together.
Figure 4:
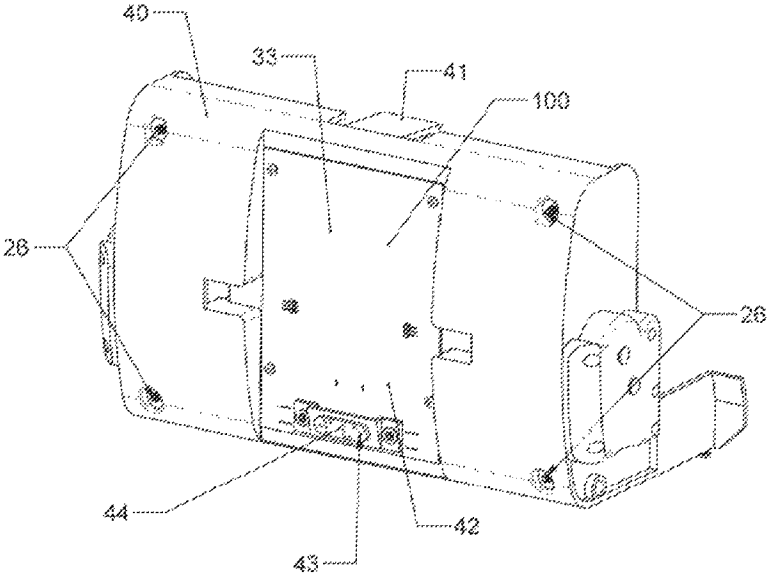
FIG. 4 is a perspective view of a power module showing its side with circuit board and sensors.

Referring to FIG. 2B, the front cover 20 defines a pair of mounting slots 14 and 16 on each side of its base. The power module 40 is installed inside the front cover 20 by attaching a fastener at mounting point 26. Referring to FIG. 3, the power module 40 has a pair of mounting pins 27 and 28 that insert through their respective mounting slots 14 and 16 located on the front cover 20 to further secure the power module 40 to the front cover 20. Referring to FIG. 4, a locking latch 41 secures the power module 40 to the main chassis 60 when the front cover 20 is in a closed position. The power module 40 further includes a circuit board 42 where a controller 100 is installed. The circuit board 42 includes a communication device to allow the dispenser to communicate with a network, such as a network interface card or a Wi-Fi antenna. In one embodiment, the communication device is a network interface card 35 (FIG. 5A) that can communicate with a communications network, such as the internet, to provide the status of the dispenser. For instance, the network interface card 35 can report any operating errors, such as toilet paper jams, the status of the batteries, whether the front cover 20 is closed properly, and whether any of the toilet paper rolls are empty. In certain embodiments, each dispenser 18 has a unique identifier, such as a serial number, that has a corresponding predefined location saved in the controller. The identifier allows a facilities manager to know exactly the location and status of each dispenser. The network interface card 35 can communicate with a server based cloud application so a user of a mobile computer or smartphone device can be notified by text or email to service one or more dispensers. The network interface card 35 can also communicate the presence of someone in the stall and number of times each stall has been used, as detected by the occupant sensor 39. This feature provides security benefits to the facilities where the dispensers are installed. For instance, when closing a facility, the dispensers can be used to ensure that no one is in a bathroom stall, such as those who are hiding or those who are unconscious. Next, the circuit board 42 also includes a tilt sensor 33, such as a dual axis sensor, for detecting the position of the front cover 20. Since the front cover 20 and the power module 40 are attached to each other, the power module 40 assumes the same position as the front cover 20. When the tilt sensor 33 senses that it is lying on a horizontal axis, the tilt sensor 33 sends an open door signal to the controller indicating that the front cover 20 is open and is separated from the main chassis 60. When the tilt sensor 33 senses that it is lying on vertical axis, the tilt sensor 33 sends a close door signal to the controller indicating that the front cover 20 is closed and is secured to the main chassis 60. The controller transmits the closed and open door signal to the network interface card 35 and the notification LED 44.

The notification LED 44 serves as a local indicator of the status of the dispenser. For instance, the LED 44 can display a flashing green light to indicate that a hand is detected and toilet paper is being dispensed, a yellow light flashing twice when there is no more toilet paper on one of the rolls, and a red light when both rolls are empty. The LED 44 also provides information on the status of the batteries. For instance, the LED 44 can display a green light to indicate that the batteries are charged, a yellow light flashing once when the batteries are low (e.g. 80% left), and a red light when the batteries need replacement (e.g. 90% left). The LED 44 can also display a red light when the front cover 20 is in the open position. A red LED light can also indicate system fault. The LED 44 may flash a green light so a user can know where to wave a hand to request for toilet paper. The flashing green light may also indicate a good dispenser condition wherein the rolls have toilet paper, the front cover is closed, the batteries are charged, there are no jams, and toilet paper is being fed through the cutting edges 24 and 25.

Figure 5A:
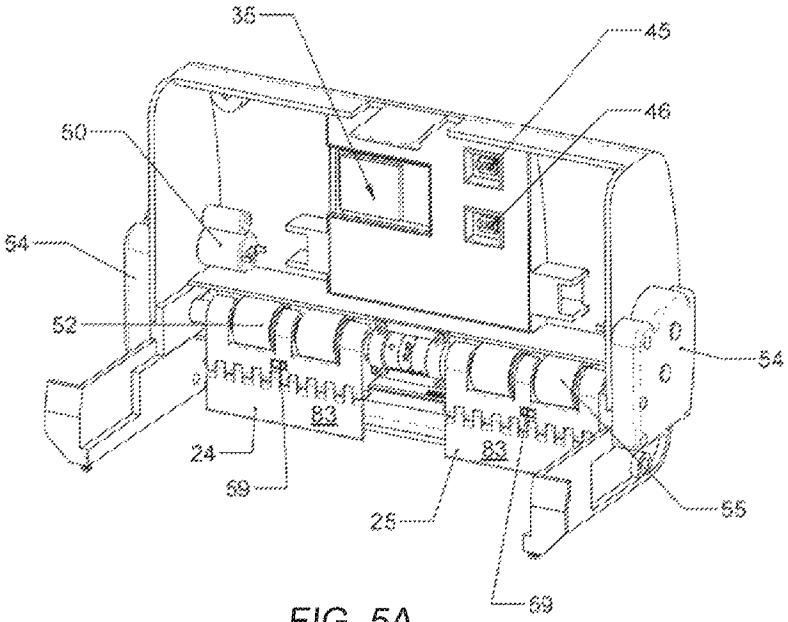
FIG. 5A is a perspective view of the power module of FIG. 4 showing its motor side.

Referring to FIG. 5A, dual in-line package (DIP) switches 45 and 46 are found inside the power module 40. The DIP switch 45 for the delay time setting and the DIP switch 46 for the paper length setting work with the hand motion sensor 43 and the controller 100. DIP switch 46 adjusts the desired length of toilet paper to be dispensed each time the hand motion sensor 43 senses a hand motion. DIP switch 45 adjusts the desired delay between sensing intervals. In one embodiment, there are 4 delay settings, which set the amount of time between the time the hand motion sensor 43 senses a hand motion and the time the toilet paper is dispensed. The 4 delay settings are—no delay, short delay (e.g. 2 seconds), moderate delay (e.g. 4 seconds), and long delay (e.g. 6 seconds). The DIP switch 46 for the paper length setting sets a predefined maximum length of toilet paper to dispense. For instance, it can be set to 8 inches, 16 inches, 24 inches or continuous dispensing (no length limit) before the dispensed sheets are removed from the dispenser. As an example, if the dispenser is set to 24 inches, upon a hand wave, 24 inches are expended from the dispenser. To prevent paper from touching the floor and getting contaminated, further hand waves will not dispense any additional toilet paper until the toilet paper is removed, or until the delay time set on the DIP switch 45 for the delay time setting has lapsed. The DIP switch 45 for the delay time setting sets the amount of time the dispenser will wait between hand waves to dispense the toilet paper. The DIP switches 45 and 46 are connected to the controller 100. The settings of the DIP switches 45 and 46 are adjustable in the firmware.

Figure 5B:
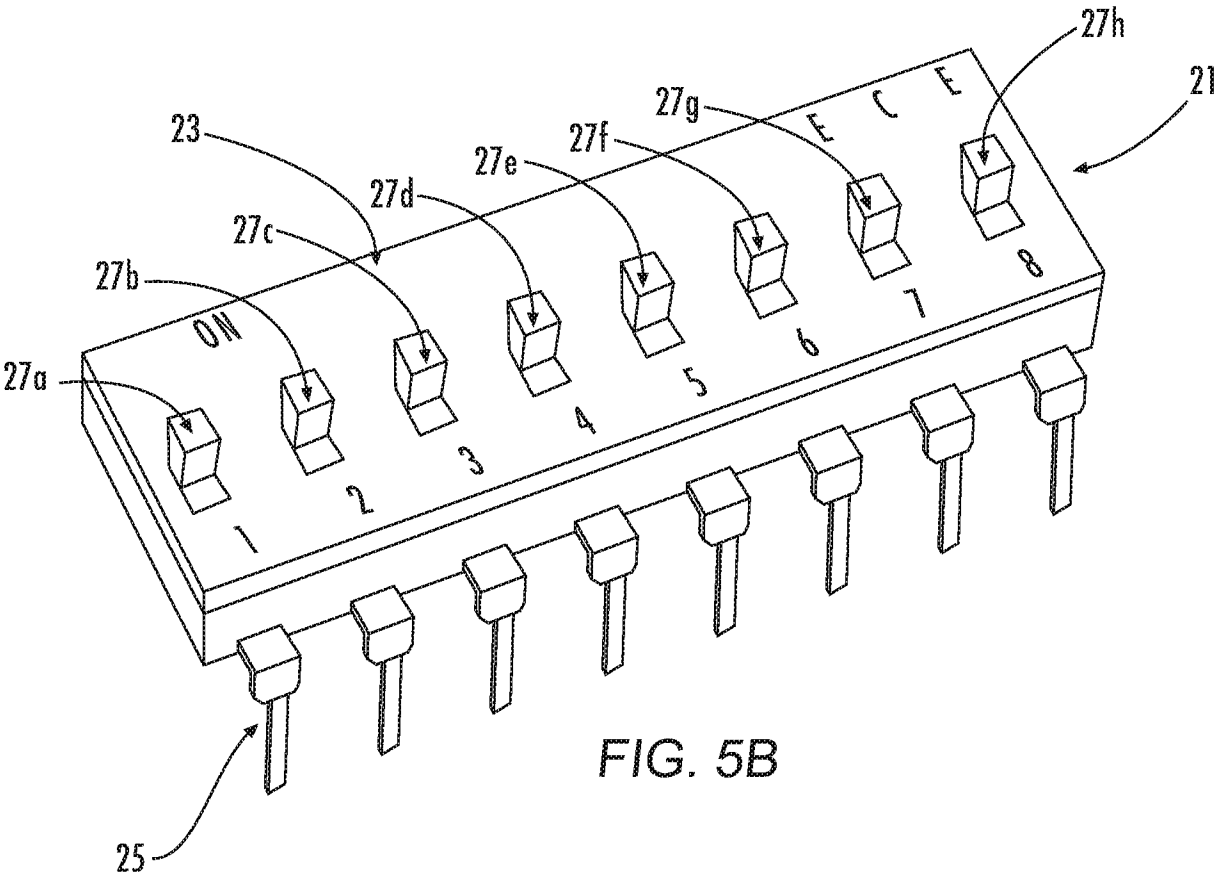
FIG. 5B is a perspective view of a dual-in line package switch for use with the toilet paper dispenser of the present disclosure.

FIG. 5B shows a DIP switch 21 that may be used as DIP switch 45 or 46. DIP switch 21 includes a base 23 with several contact pins 25 below the base 23 for connection with a circuit board. DIP switch 21 has multiple levers 27*a-h* positioned on the base 23 in series. The levers 27*a-h* are either slidable, rockable, or rotatable. Accordingly, the DIP switch can be a slide type, a rocker type, or a rotary type. The levers 27*a-h* can be moved from an on position to an off position, which corresponds to a one-bit binary value that can be read by the firmware. The values of all levers can also be interpreted as one number that can be read by the firmware. In one example setting, the levers 27*a-h* can be positioned so that the firmware interprets the arrangement of the levers to indicate no delay or the dispenser not to wait for the next hand wave before dispensing the product. In other settings, the levers can be arranged so that the firmware interprets their arrangement to indicate short delay (e.g. 2 seconds), moderate delay (e.g. 4 seconds), or long delay (e.g. 6 seconds) for the dispenser to wait between hand waves before dispensing the paper product. Another DIP switch 21 can be set so that the firmware interprets the arrangement of the levers to indicate either dispensing 8 inches of paper as a maximum amount of paper to dispense in between hand waves, 16 inches, 24 inches or continuous dispensing (no length limit).

Figure 14:
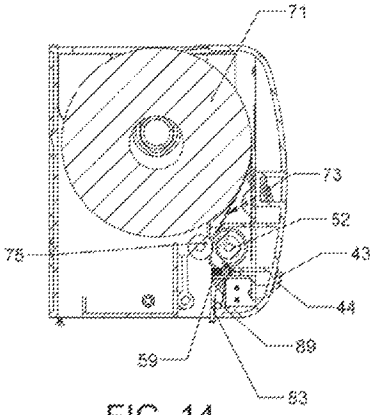
FIG. 14 is a cross-sectional view taken from line 14 of FIG. 11.

Each side of the dispenser has a separate drive motor 50 and 51 that drives their respective gear boxes 54 to turn their respective power rollers 52 and 55. When the front cover 20 is closed, the power rollers 52 and 55 are face-to-face with their respective idle rollers 69 and 75 (FIG. 14). The toilet paper ends 73 and 74 pass in between their respective power rollers 52 and 55 and their respective idle rollers 69 and 75. The toilet paper ends 73 and 74 are pinched between the power roller and the idle roller to prevent toilet paper being pulled off of the roll after the length of toilet paper that was set using the DIP switch has already been dispensed. Paper empty sensors 59 are provided for each toilet paper roll and are positioned below their respective power rollers 52 and 55. The paper empty sensors 59 are preferably in the form of optical sensors. The paper empty sensor 59 detects the presence of toilet paper in front of it. If a paper empty sensor 59 does not detect toilet paper in front of it, it sends a signal to a controller 100, which can mean that the toilet paper is out for the toilet paper roll that is directly above it or that the toilet paper is jammed above the paper empty sensor 59 such that it is not passing through the paper empty sensor 59.

Below the power rollers 52 and 55 are paper cutoff bars 83 that are pivotably attached to the power module 40. The toilet paper ends 73 and 74 abut to their respective paper cutoff bars 83, which are pulled by a user and torn by the respective cutting edges 24 and 25. As the toilet paper ends 73 and 75 are pulled, the paper cutoff bars 83 pivot towards and press their respective micro switches 89 (FIG. 14). The micro switches 89 send a reset signal to the controller 100 to start a new paper dispense cycle wherein a fresh toilet paper with the length specified using the DIP switch setting 46 will be dispensed when the hand motion sensor 43 senses a hand motion.

Figure 7:
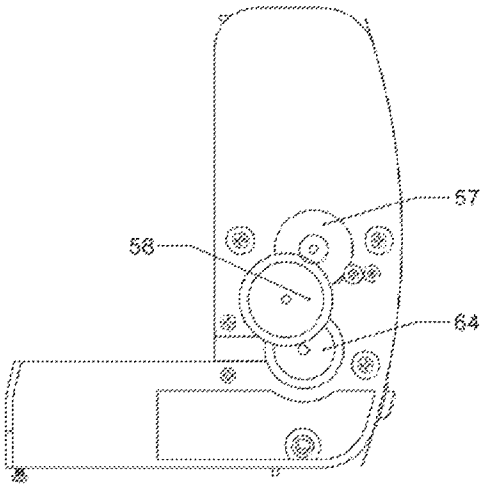
FIG. 7 is a side view of the power module showing its transmission.
Figure 6:
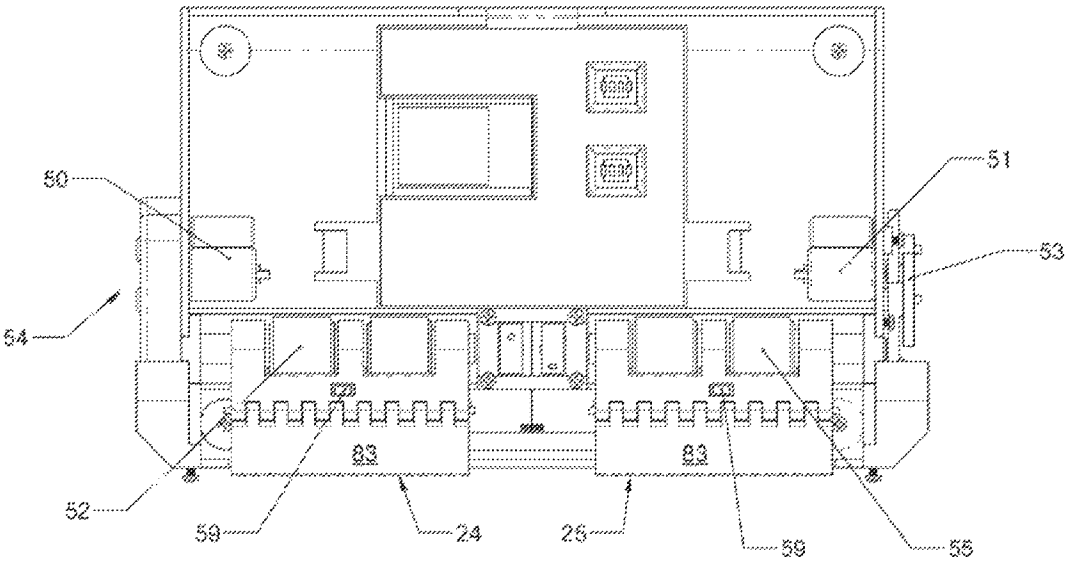
FIG. 6 is a front view of the power module showing its motor side.

Referring to FIG. 6, motors 50 and 51 drive its respective spindle that holds the toilet paper roll. Each motor 50 and 51 is connected to its respective gear box 51 and 54 that houses a transmission 53. In FIG. 7, each transmission 53 includes several gears 57, 58, and 64 that rotate amongst each other to drive their respective motors 50 and 51. The transmission 53 includes a motor gear attached to the motor, one or more reduction gears to reduce the speed of the power rollers, and an output gear attached to the power roller to increase torque.

Figure 8:
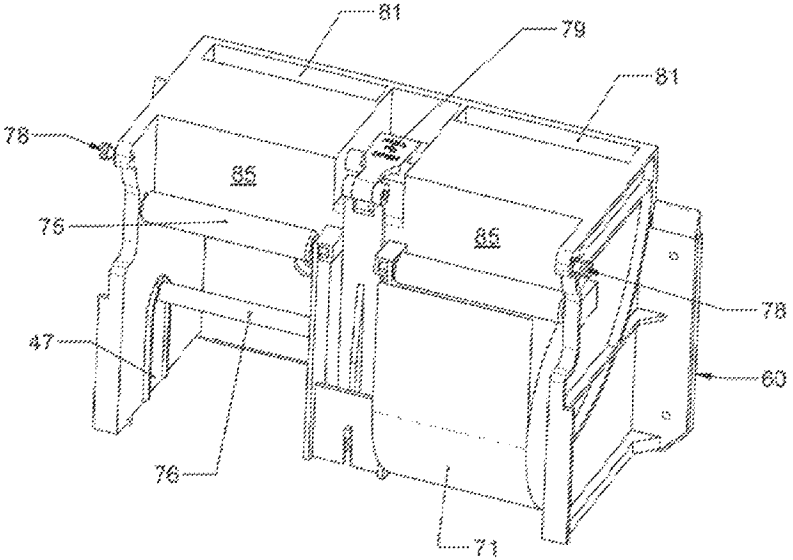
FIG. 8 is a perspective view of the main chassis with its underside being positioned on top.
Figure 10:
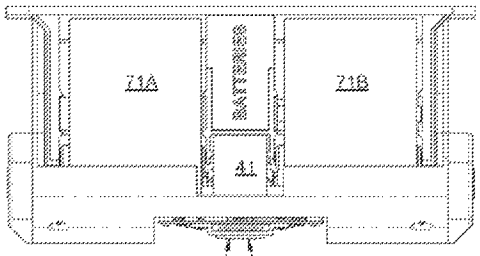
FIG. 10 is a top plan view of the power module and the main chassis attached together.

FIG. 8 is a perspective view showing the front of the main chassis 60 that is positioned upside down to show a concealed release lever 79 located on the underside of the main chassis 60. The release lever 79 releases the front cover 20 from the main chassis 60. Pivot pins 78 of the main chassis 60 engage with pivot pin retainers 77 of the power module 40 to allow the front cover 20 and the power module 40 to pivot around the main chassis 60. The location of the pivot pins 78 allows the front cover 20 to rotate open in a controlled manner without slamming. A full roll of toilet paper 71 is provided and shown on one side, and an empty spindle 76 is shown on the other side. The dispenser can feed cored, compact, and coreless rolls of toilet paper. The spindles 76 can be provided with multiple sizes. For instance, there can be a spindle that can accommodate a cored roll of toilet paper, a coreless roll of toilet paper, or a compact roll of toilet paper. When replacing the roll of toilet paper, spindle 76 is removed from the spindle slot 47. The spindle 76 is inserted into a roll of cored or coreless toilet paper roll and then re-inserted into the spindle slot 47. FIG. 8 also shows a pair of discharge holes 81 defined by the base of the main chassis 60. The discharge holes 81 are optional and are designed to allow dust and unwanted paper pieces coming from the toilet paper rolls to come out of the dispenser and not accumulate within the dispenser.

Figure 9:
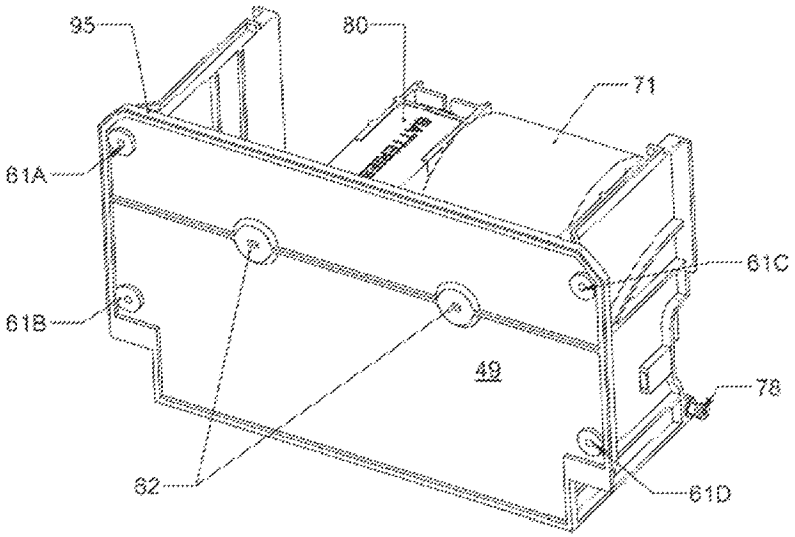
FIG. 9 is a perspective view of the rear side of the main chassis.

FIG. 9 is a perspective view showing the rear of the main chassis 60. Main chassis 60 includes a rear wall 49 that defines mounting holes 61*a-d* for mounting the dispenser to a wall or other structure. The dispenser is configured to be mounted on a vertical wall or surface by fastening through the mounting holes 61*a-d* on the rear wall 49. Alternative mounting holes 62 are provided and are intended to be compatible with wall mounted manual toilet paper dispensers that are commonly used. When replacing the manual toilet paper dispensers with the dispenser of the present disclosure, fasteners may be inserted through the alternative mounting holes 62 to mount the dispenser of the present disclosure. A gasket 95 surrounds the rear wall 49 of the main chassis 60 to seal the interior of the dispenser from a restroom wash-down or other restroom cleaning. A battery compartment 80 is also shown and preferably houses four size D batteries. These batteries provide sufficient life for about one-year of operation.

FIGS. 10-13 are the top plan view, front view, bottom plan view, and side views of the main chassis 60 and the power module 40 attached together, respectively. Two rolls of toilet paper 71*a* and 71*b* are provided within the main chassis 60. Locking latch 41 detachably attaches the power module 40 to the main chassis 60. The hand motion sensor 43 and the LED 44 are positioned below the circuit board 42. When the main chassis 60 and the power module 40 are attached, toilet paper passages 87 are formed on each side of the dispenser that is separated by the release lever 79. The toilet paper passages 87 are formed in between the paper cutoff bars 83 of the power module 40 (FIG. 6) and a main chassis wall 85 (FIG. 8) that is adjacent to the idle rollers 75. Toilet paper ends 73 and 74 go through a small slit in between the idle rollers 75 and paper cutoff bar 83 and then through their respective toilet paper passages 87. When the front cover 20 is closed, the front cover 20 and the main chassis 60 encase the internal components, such as the spindles, the motor, the controller, and the hand motion sensor, and the toilet paper and protect them from airborne contaminants that may land or fall on them. The front cover 20 and the main chassis 60 form a sealed enclosure that seals off the dispenser from all sides except for the underside that defines the toilet paper passages 87 and the discharge holes 81.

Figure 11:
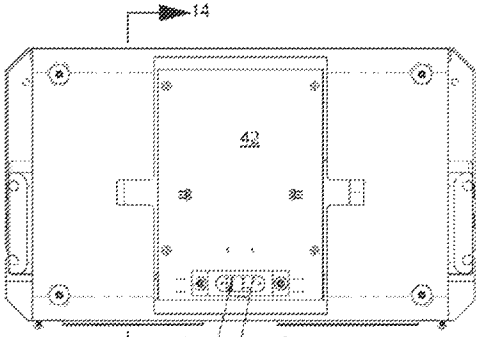
FIG. 11 is a front view of FIG. 10.
Figure 13:
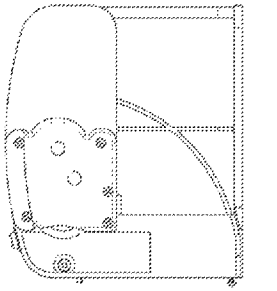
FIG. 13 is a right side view of FIG. 10.
Figure 12:
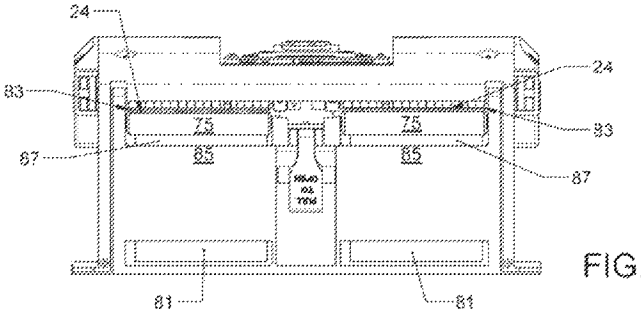
FIG. 12 is a bottom plan view of FIG. 10.

FIG. 14 shows a cross-sectional view taken from line 14 that is drawn on FIG. 11. The free end 73 of the toilet paper from the roll 71 is fed between the power roller 52 and the idle roller 75. The free end 73 gets pinched between the power roller 52 and the idle roller 75 to prevent the toilet paper being pulled off of the roll after the length of toilet paper that was set using the DIP switch has already been dispensed. The idle roller 75 is spring-loaded. The free end 73 passes through the paper empty sensor 59, which detects the presence of toilet paper in front of it. If the paper empty sensor 59 does not detect toilet paper in front of it, it sends a signal to a controller 100. The signal can mean that the toilet paper is out for the toilet paper roll 71 or that the toilet paper is jammed above the paper empty sensor 59 such that it is not passing through the paper empty sensor 59. The notification LED 44 and the hand motion sensor 43 are also shown. The notification LED 44 flashes a yellow light when one of the paper empty sensors 59 does not detect a toilet paper in front of it, or it flashes a red light when two out of the two paper empty sensors 59 do not detect toilet paper in front of them. The free end 73 abuts to the paper cutoff bar 83. When the free end 73 is pulled at an angle, the cutting edges at the end of the paper cutoff bar will cut the toilet paper and the paper cutoff bar 83 pivots towards and presses the microswitch 89. The microswitch 89 sends a reset signal to the controller 100 to start a new paper dispense cycle wherein a fresh toilet paper with the length specified using the DIP switch setting 46 will be dispensed when the hand motion sensor 43 senses a hand motion.

Figure 15:
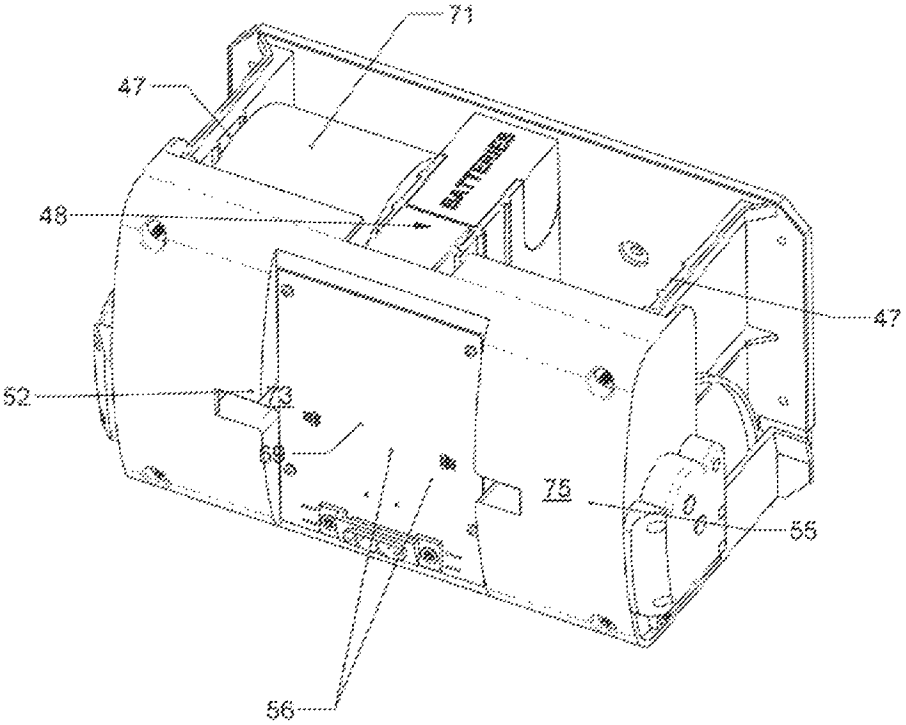
FIG. 15 is a perspective view of an embodiment of the toilet paper dispenser with the front cover, power module, and main chassis attached together.

FIG. 15 shows a perspective view of the toilet paper dispenser with the front cover 20 in an open position. Toilet paper 71 is placed on a spindle, which inserted into the spindle slot. The free end 73 of the toilet paper is fed over the idle roller 69. Power rollers 52 drive the toilet paper 71 to be dispensed. A revolution sensor 56 is positioned in between the power rollers 52 and 55. The revolution sensor 56 detects the number of rotations of each power roller 52 or 55. The number of rotations detected is used to calculate how much toilet paper has been dispensed and how much toilet paper is left on the toilet paper roll 71. For instance, if it is determined that it takes x number of power roller rotations to dispense an entire toilet paper roll, the number of current power roller rotations y can be compared with x. If x is greater than y, that means there is still toilet paper on the roll. If y is equal to or greater than x, there is no more toilet paper on the roll. Release latch 48 allows the power module 40 to be partially detached from the main chassis 60 for replacement of batteries, adjustment of the length and delay settings using the DIP switches, and installing new rolls of toilet paper 71. The number of rotations of each power roller that is detected by the revolution sensor 56 may also be used by the controller to dispense the length of toilet paper that is set on the DIP switch setting.

Figure 16:
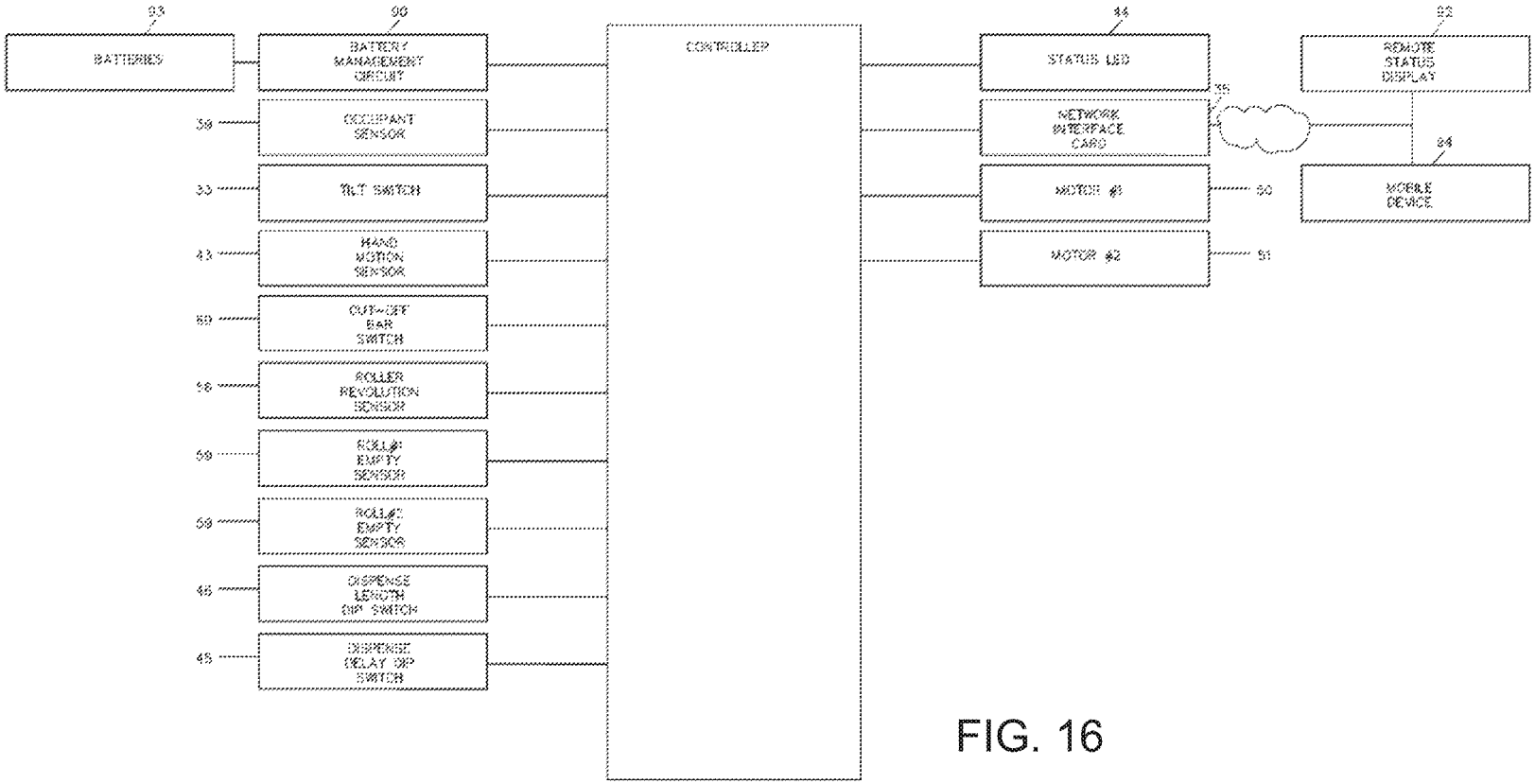
FIG. 16 is an electrical block diagram of an embodiment of the dispenser.

FIG. 16 shows an electrical block diagram of an embodiment of the dispenser. Batteries 93 provide power to the components of the dispenser and are connected to a battery management circuit 90 that is in communication with the controller 100. The battery management circuit 90 detects how much power is left with the batteries and communicates the status of the batteries to the controller. In certain embodiments, the battery management circuit 90 is set to send a signal to the controller when the batteries have 10 percent life left. The hand motion sensor 43, occupant sensor 39, tilt sensor 33, paper cutoff bar microswitch 89, and the revolution sensor 56 are all connected to the controller 100 and transmit signals to the controller 100. From the perspective of the input of signals, the hand motion sensor 43 detects a hand motion and sends a signal to the controller 100. The occupant sensor 39 detects the presence of an occupant near the dispenser and sends a signal to the controller upon detection of an occupant. The tilt sensor 33 detects the orientation of the front cover 20 and sends a front cover open or front cover closed signal to the controller depending on its orientation. The paper cutoff bar microswitch 89 detects pressure indicating that the paper has been pulled and cut using the cutting edges and sends the pressure signal to the controller. The revolution sensor 56 detects the number of rotations of power roller 52 and 55 and sends this information to the controller 100. The paper empty sensors 59 detect paper passing in front of it and sends this information to the controller 100.

On the output side, the controller 100 is connected to the motors 50 and 51 and activates one motor at a time after it has processed the signals. For instance, when the controller receives a signal from the hand motion sensor 43, it checks the signal from the paper empty sensors 59 to activate only the motor 50 or 51 that corresponds to the toilet paper roll that is not empty or that is not jammed. The controller 100 also checks the signals from the revolution sensor 56 to further ensure that the toilet paper roll corresponding to the motor it activates is not empty. The controller 100 also checks the signals from the paper cutoff bar microswitch 89 to ensure that previously dispensed paper has been removed. The controller 100 has an integrated memory and firmware programmed therein.

Figure 17:
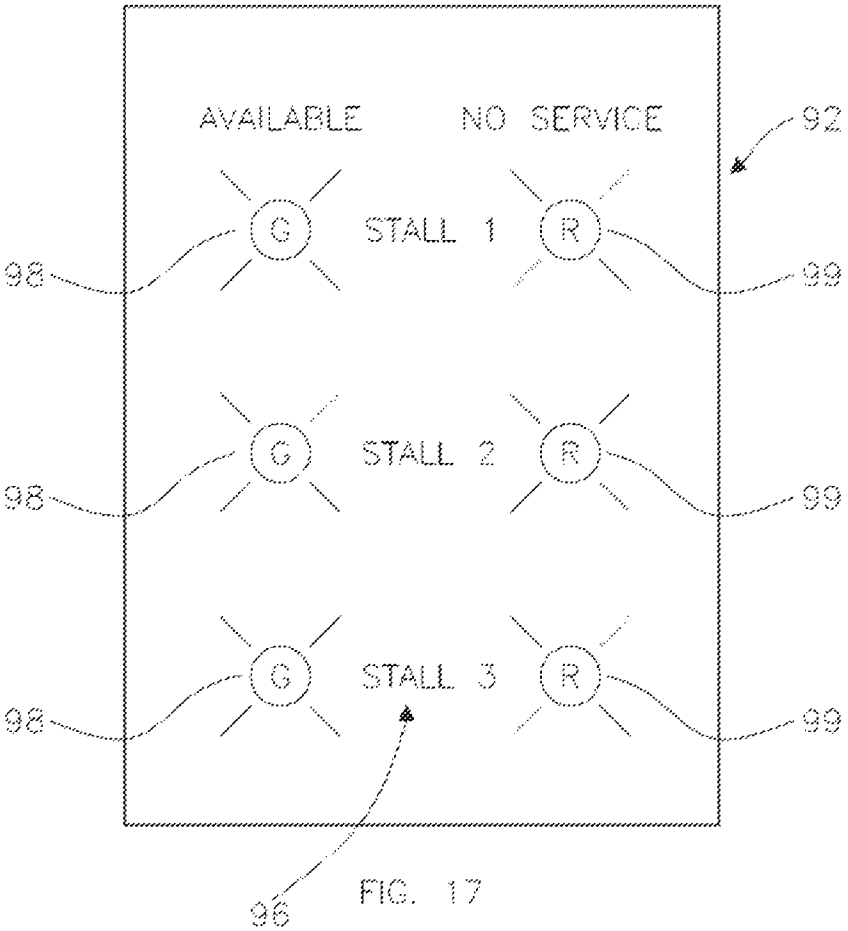
FIG. 17 is a front view of an embodiment of a remote status display.

The controller 100 is also connected to the notification LED 44, the network interface card 35, and a remote status display 92, which is shown in FIG. 17. The controller 100 checks the battery status using the signal from the battery management circuit 90. For instance, depending on the signal from the battery management circuit 90, the controller 100 can cause the LED 44 to display a green light to indicate that the batteries are charged, a yellow light flashing once when the batteries are low, and a red light when the batteries need replacement. The controller 100 also checks the status of the front cover using the tilt sensor 33. The controller can cause the LED 44 to display a red light when the front cover 20 is in the open position. The controller 100 may also check on the paper empty sensors 59 and cause the LED 44 to display a yellow light flashing twice when there is no more toilet paper on one of the rolls, and a red light when both rolls are empty.

A network interface card 35 is connected with the controller 100 so data pertaining to the dispenser can be accessed by computers and mobile devices 94 that are connected to a network, such as the internet. The computers and mobile devices may include a software or mobile application that provides a user interface. The user interface may be able to show the different dispensers being monitored, whether there are any current occupants at or near each dispenser, how many occupants have been detected at or near each dispenser, and the status of each component of each dispenser. The status may include how much charge is in the battery of each dispenser, the position of the front cover of each dispenser, and whether paper is passing through the paper empty sensors. The software may be programmed to summon for service or send service alert when batteries or toilet paper rolls need to be replenished, when the front cover needs to be closed, when paper is not passing through a paper empty sensor, or when the toilet paper jam needs to be fixed. The software may further include a feature where the service alerts are sent through social media, such as Twitter. The service alerts may further be sent through various electronic outlets, such as e-mail or text message.

FIG. 17 shows a remote status display 92 that can be mounted to a visible location within a restroom, such as a board over the sinks at an entry into a restroom. The remote status display 92 identifies the stalls 96 in which each dispenser is installed. Each stall 96 has an available light 98 and an out of service light 99. The available light 98 indicates whether there is an occupant in the stall. It flashes a green light if it is vacant. It flashes a red light if it is occupied. The out of service light 99 indicates that at least one of the following situations exists: front cover is open, at least one of the toilet paper rolls is empty, the batteries are not adequately charged, or the paper is not passing through the paper empty sensor. The remote status display 92 may be wired with the controller 100. Alternatively, it may connect wirelessly to the controller 100 through the network interface card 35. The remote status display 92 provides a practical tool to patrons and maintenance personnel to ensure that the paper product dispenser in the stall is working properly. It also identifies available stalls for the patrons.

Figure 18:
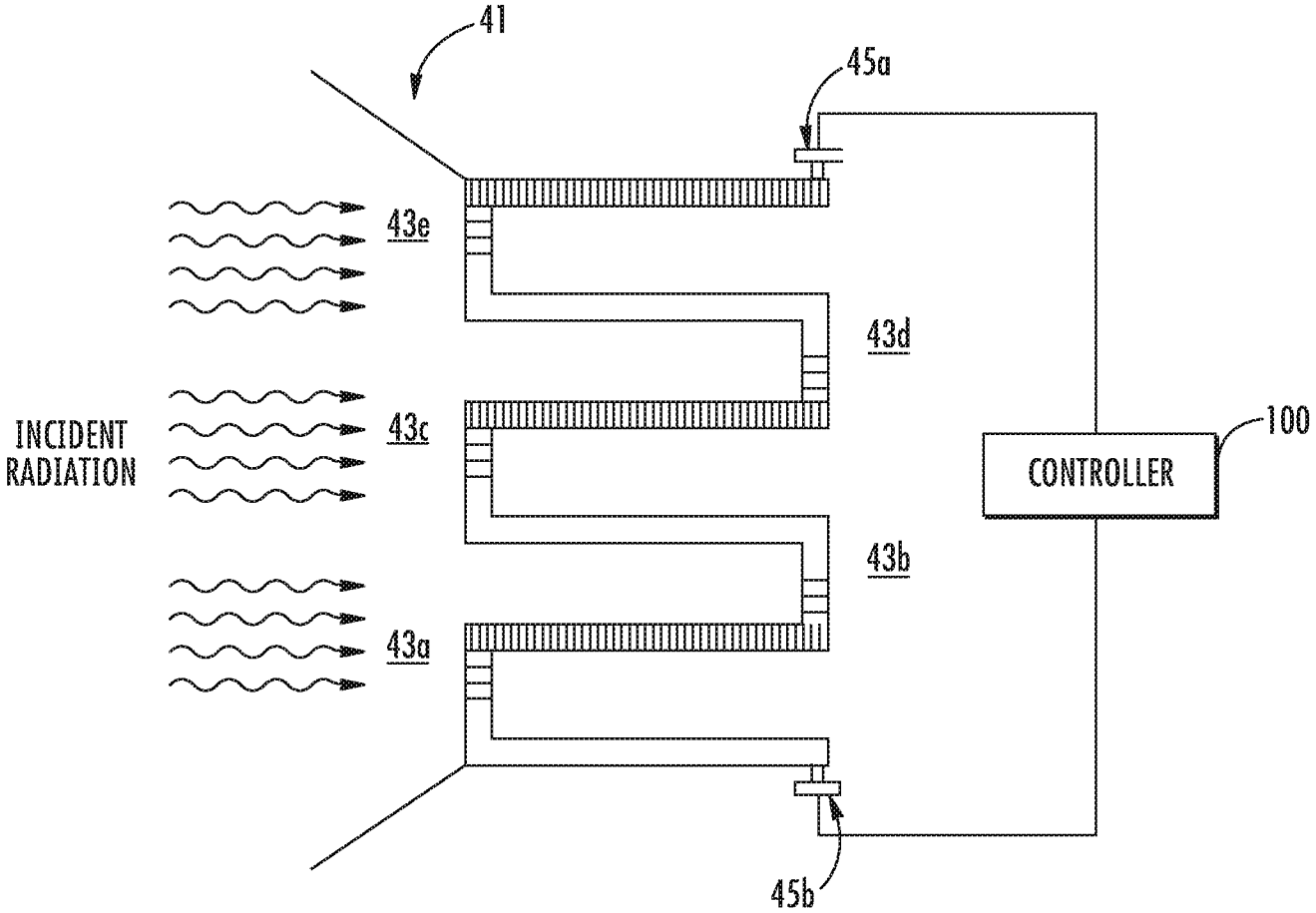
FIG. 18 is a schematic view of several thermocouples that form a thermopile sensor.

FIG. 18 shows a thermopile sensor 41 that can serve as the occupant sensor 39. Thermopile sensor 41 includes multiple thermocouples 43*a*, 43*b*, 43*c*, 43*d*, and 43*e* connected in series. The ends 45*a* and 45*b* of the interconnected thermocouples are connected to the controller 100. Thermocouples 43*a*, 43*c*, and 43*e* are made of a metal that is different from the metal of thermocouples 43*b* and 43*d*. For instance, thermocouples may be a type K (nickel-chromium/nickel-alumel), type J (iron/constantan), type T (copper/constantan), type E (nickel-chromium/constantan), type N (nicrosil, nisil), type S (platinum 10% rhodium/platinum), type R (platinum 13% rhodium/platinum), or type B (platinum 30% rhodium/platinum 6% rhodium) thermocouple. Thermocouples 43*a*, 43*c*, and 43*e* form junction A and thermocouples 43*b* and 43*d* form junction B. When thermal radiation falls on thermocouples 43*a*, 43*c*, and 43*e* or junction A, the difference in the temperature between junctions A and B generates a thermo electromagnetic field, which consequently generates a signal or a temperature-dependent voltage to the controller 100. The thermopile sensor 41 generates an output voltage proportional to ambient temperature difference or temperature gradient. The controller 100, in turn, processes the signal. For instance, upon receiving the signal, the controller 100 causes the available light 98 of the remote status display 92 shown in FIG. 17 to flash a red light.

Figure 20:
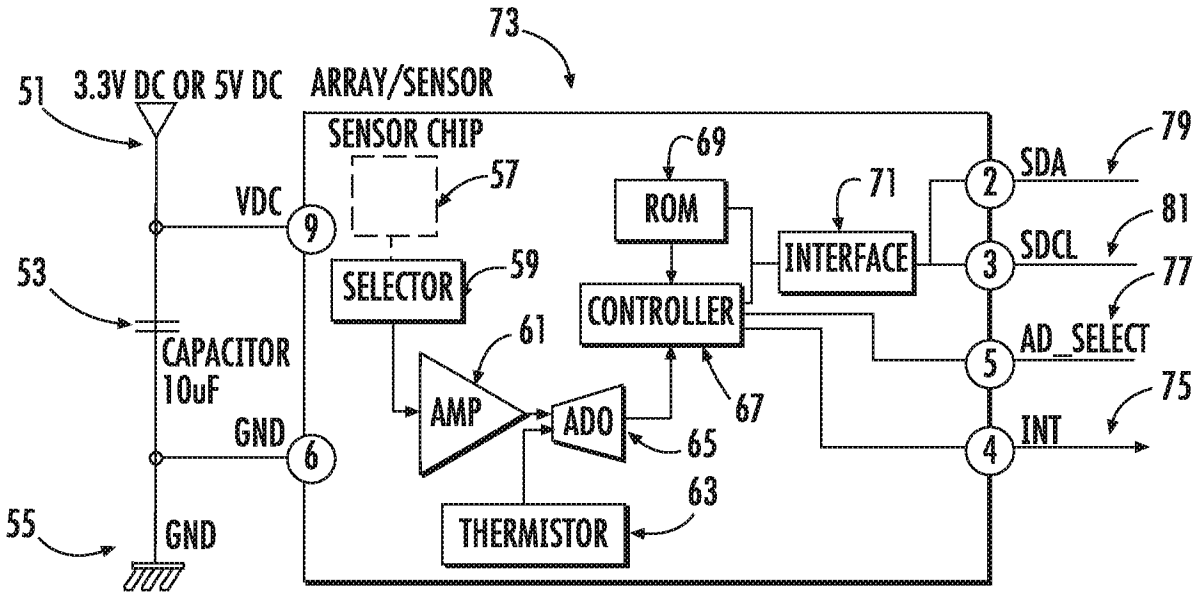
FIG. 20 is a circuit diagram of the thermopile sensor of FIGS. 19*a-d*.

FIGS. 19*a-d* shows a thermopile sensor 45 manufactured by Panasonic Corporation and sold as "Infrared Array Sensor Grid-EYE" that can also serve as the occupant sensor 39. Thermopile sensor 45 that includes a silicon lens 49 at the front and a built-in pixel array 47 of 64 thermopiles 31 in an 8×8 grid configuration. Each thermopile includes multiple thermocouples, such as those shown in FIG. 18. Referring to FIG. 20, the thermopile sensor 45 includes a circuit 73 that has a voltage source 51 connected to a capacitor 53, which is connected to a ground 55. The capacitor 53 suppresses high-frequency noise and voltage spikes to protect the sensor integrated circuit or chip 57. The power source 51 supplies power to the sensor integrated circuit 57, which may house the thermopiles. The thermopile sensor 45 further includes a selector 59, an amplifier 61, a thermistor 63, an analog-to-digital converter 65, a controller 67, a read-only memory 69, and an interface 71. Selector 59 selects one pixel at a time out of the 64 thermopiles from the pixel array 47. The selector 59 sends analog data from the chip 57 to the amplifier 61, which amplifies the analog data signal to a predetermined level. The thermistor 63 measures the temperature of the ambient environment as an analog signal and uses this signal as a reference value. This signal is stored is stored in the read-only memory 69. The analog-to-digital converter 65 receives the amplified data signal and converts it to a digital signal considering the reference value from the thermistor 63. The thermopile controller 67 processes the digital signal and compares it with the stored reference values in the read-only memory 69. Depending on the signal, the thermopile controller 67 sends an interrupt signal 75 to a component to enable output, or it will seed the sensor's address via address select line 77 (AD SELECT) to enable communication. The thermopile controller 67 may also send the data to the interface 71, which sends the data to a component through the SDA line 79 according to the synchronous clock signal (SCL) share between the devices. For instance, the interface 71 sends the data via the SDA line 79 to the controller 100, which in turn, processes the signal. Upon receiving the signal, the controller 100 causes the available light 98 of the remote status display 92 shown in FIG. 17 to flash a red light.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A toilet paper dispenser comprising:

a toilet paper spindle adapted to hold and dispense a toilet paper roll;

at least one motor connected to the toilet paper spindle;

a controller connected to the motor; and a thermopile sensor in n with the controller and comprising a plurality of thermocouples that form a junction A and a junction B, wherein when the thermocouples sense thermal radiation, a thermal gradient between junction A and junction B is created, the thermal gradient generating an electrical signal that the thermopile sensor sends to the controller.

2. The toilet paper dispenser of claim 1, wherein the thermocouples are connected in series.

3. The toilet paper dispenser of claim 1, wherein the thermocouples are made of different metals.

4. The toilet paper dispenser of claim 1, further comprising a remote status display connected to the controller, wherein when the controller receivers the electrical signal from the thermopile sensor, the remote status display flashes a light.

5. The toilet paper dispenser of claim 1, further comprising a network interface card connected to the controller and adapted to connect the toilet paper dispenser to a network.

6. The toilet paper dispenser of claim 5, further comprising a front cover and a front cover sensor adapted to detect an open position of the front cover, the front cover sensor being in communication with the controller, wherein when the front cover is in an open position, the front cover sensor sends a signal to the controller, the controller sends a service signal through the network that can be received by a device that is connected to the network.

7. A paper product dispenser comprising:

a motor adapted to dispense a paper product;

a controller; and a thermopile sensor in communication with the controller, the thermopile sensor including a plurality of thermocouples adapted to detect a change in temperature, wherein when the thermopile sensor detects a change in the temperature, the thermopile sensor sends a signal to the controller, the controller processes the signal and compiles the signal to generate occupancy data.

8. The paper product dispenser of claim 7, further comprising a communication device in communication with the controller and adapted to connect the paper product dispenser to a network, wherein the controller sends the occupancy data to the network.

9. The paper product dispenser of claim 8, further comprising a front cover, a main chassis that encase the paper product dispenser, and a front cover sensor adapted to detect an open position of the front cover, the front cover sensor being in communication with the controller, wherein when the front cover is in the open position, the front cover sensor sends a signal to the controller, the controller sends a service signal through the network that can be received by a device that is connected to the network.

10. The paper product dispenser of claim 8, further comprising an array of thermopile sensors in communication with the controller, each thermopile sensor Including a plurality of thermocouples adapted to detect a change in temperature, wherein when the thermopile sensor detects a change in the temperature, the thermopile sensor sends a signal to the controller, the controller processes the signal and compiles the signal to generate occupancy data that is seat to the network.

11. The paper product dispenser of claim 7, wherein the thermopile sensor includes a thermistor that measures a temperature of ambient environment as an analog signal and uses this analog signal as a reference value and an analog-to-digital converter to convert the analog signal to a digital signal, the thermopile sensor adapted to send the digital signal to the controller.

12. The paper product dispenser of claim 7, wherein the controller includes a firmware and further comprising a dual in-line package switch connected to the controller, the dual in-line package switch including a plurality of levers arranged in series, each lever being moveable in a plurality of positions, the positions of the levers being readable by the firmware.

13. The paper product dispenser of claim 12, wherein the firmware adjusts a predefined interval of time when the dispenser dispenses the paper product after detecting a subsequent hand wave depending on the positions of the lever of the dual in-line package switch.

14. The paper product dispenser of claim 12, wherein the firmware adjusts a predefined maximum length of paper to dispense between hand waves depending on the positions of the lever of the dual in-line package switch.

15. A paper product dispenser comprising:

a motor adapted to dispense a paper product;

a controller having a firmware;

a front cover enabled to at least enclose the toilet paper roll and spindle;

an infrared sensor in communication with the controller and aligned with an opening of the front cover;

a thermopile sensor in communication with the controller, the thermopile sensor including a plurality of thermocouples adapted to detect a change in temperature, wherein when the thermopile sensor detects the change in the temperature, the thermopile sensor sends a signal to the controller indicating presence of an occupant; and a dual in-line package switch connected to the controller, the dual in-line package switch including a plurality of levers arranged in series, each lever being moveable in a plurality of positions, the positions of the levers being readable by the firmware.

16. The paper product dispenser of claim 15, wherein the firmware adjusts a predefined interval of time when the dispenser dispenses the paper product after detecting a subsequent hand wave by the infrared sensor, depending on the positions of the lever of the dual in-line package switch.

17. The paper product dispenser of claim 15, wherein the firmware adjusts a predefined maximum length of paper to dispense between hand waves depending on the positions of the lever of the dual in-line package switch.

18. The paper product dispenser of claim 15, further comprising a remote status display connected to the controller, wherein when the controller receivers the signal from the thermopile sensor, the remote status display flashes a light.

19. The paper product dispenser of claim 15, further comprising a network interface card connected to the controller and adapted to connect the paper product dispenser to a network, and a front cover sensor adapted to detect an open position of the front cover, the front cover sensor being in communication with the controller, wherein when the front cover is in an open position, the front cover sensor sends a signal to the controller, the controller sends a service signal through the network that can be received by a device that is connected to the network.

20. A toilet paper dispenser comprising:

a toilet paper spindle adapted to hold and dispense a toilet paper roll;

at least one motor connected to the toilet paper spindle;

a controller connected to the motor;

a front cover enabled to at least enclose the toilet paper roll and spindle;

a hand wave sensor in communication with the controller and aligned with an opening of the front cover; and an occupant sensor for sensing thermal radiation in communication with the controller;

wherein, when the hand-waive sensor detects a hand-waive, a signal is received at the controller causing to toilet paper to be dispensed and when the occupant sensor senses thermal radiation, a thermal gradient is created, the thermal gradient generating an electrical signal that the occupant sensor sends to the controller indicating the presence of an occupant.

21. The toilet paper dispenser of claim 20, wherein the hand-waive sensor is an IR sensor.

22. The toilet paper dispenser of claim 20, wherein the occupant sensor is a thermopile sensor comprising a plurality of thermocouples.

23. The toilet paper dispenser of claim 22, wherein the plurality of thermocouples are connected in series.

24. The toilet paper dispenser of claim 22, wherein the plurality of thermocouples are made of different metals.

25. The toilet paper dispenser of claim 20, further comprising a remote status display connected to the controller, wherein when the controller receivers the electrical signal from the occupant sensor, the remote status display flashes a light.

26. The toilet paper dispenser of claim 20, further comprising a network interface card connected to the controller and adapted to connect the toilet paper dispenser to a network.

27. The toilet paper dispenser of claim 20, further comprising a front cover sensor adapted to detect an open position of the front cover, the front cover sensor being in communication with the controller, wherein when the front cover is in the open position, the front cover sensor sends a signal to the controller, the controller sends a service signal through the network that can be received by a device that is connected to the network.

28. A toilet paper dispenser comprising:

a toilet paper spindle adapted to hold and dispense a toilet paper roll;

at least one motor connected to the toilet paper spindle;

a controller connected to the motor;

a front cover enabled to at least enclose the toilet paper roll and spindle;

an infrared sensor in communication with the controller and aligned with an opening of the front cover; and a thermopile sensor in communication with the controller and comprising a plurality of thermocouples that form a junction A and a junction B;

wherein when the infrared sensor detects a hand-waive, a signal is received at the controller and when the thermocouples sense thermal radiation, a thermal gradient between junction A and junction B is created, the thermal gradient generating an electrical signal that the thermopile sensor sends to the controller indicating presence of an occupant.

29. The toilet paper dispenser of claim 28, wherein the thermocouples are connected in series.

30. The toilet paper dispenser of claim 28, wherein the thermocouples are made of different metals.

31. The toilet paper dispenser of claim 28, further comprising a remote status display connected to the controller, wherein when the controller receivers the electrical signal from the thermopile sensor, the remote status display flashes a light.

32. The toilet paper dispenser of claim 28, further comprising a network interface card connected to the controller and adapted to connect the toilet paper dispenser to a network.

33. The toilet paper dispenser of claim 28, further comprising a front cover sensor adapted to detect an open position of the front cover, the front cover sensor being in communication with the controller, wherein when the front cover is in the open position, the front cover sensor sends a signal to the controller, the controller sends a service signal through the network that can be received by a device that is connected to the network.

* * * * *